US005912098A

United States Patent [19]

Tanaka et al.

[11] Patent Number: 5,912,098

[45] Date of Patent: Jun. 15, 1999

[54] ELECTROPHOTOGRAPHIC PHOTOSENSITIVE MEMBER AND ELECTROPHOTOGRAPHIC APPARATUS AND PROCESS CARTRIDGE INCLUDING SAME

[75] Inventors: Takakazu Tanaka, Numazu; Hideki Anayama, Susono; Akira Yoshida; Hidetoshi Hirano, both of Shizuoka-ken; Wataru Kitamura, Matsudo, all of Japan

[73] Assignee: Canon Kabushiki Kaisha, Tokyo, Japan

[21] Appl. No.: 08/824,334

[22] Filed: Mar. 26, 1997

[30] Foreign Application Priority Data

Mar. 27, 1996 [JP] Japan ..... 8-095850

[51] Int. Cl.[6] ..... G03G 5/147

[52] U.S. Cl. ..... 430/67; 430/58; 399/147

[58] Field of Search ..... 430/66, 67; 399/147

[56] References Cited

U.S. PATENT DOCUMENTS

| | | | |
|---|---|---|---|
| 4,455,205 | 6/1984 | Olson et al. | 204/159.13 |
| 4,923,775 | 5/1990 | Schank | 430/59 |
| 5,635,544 | 6/1997 | Tamura et al. | 522/79 |
| 5,708,048 | 1/1998 | Medford et al. | 522/64 |

FOREIGN PATENT DOCUMENTS

| | | | |
|---|---|---|---|
| 0501517 | 9/1992 | European Pat. Off. | G03G 5/05 |
| 53-103741 | 9/1978 | Japan . | |
| 56-42863 | 4/1981 | Japan . | |
| 57-30843 | 2/1982 | Japan . | |
| 60-57847 | 4/1985 | Japan . | |
| 61-5253 | 1/1986 | Japan . | |
| 1-178972 | 7/1989 | Japan . | |
| 2025079 | 1/1980 | United Kingdom | G03G 5/14 |
| WO 95-02853 | 1/1995 | WIPO | G03G 5/147 |

*Primary Examiner*—John Goodrow

*Attorney, Agent, or Firm*—Fitzpatrick, Cella, Harper & Scinto

[57] ABSTRACT

An electrophotographic photosensitive member is constituted by at least a support, a photosensitive layer disposed on the support, and a protective layer disposed on the photosensitive layer. The protective layer comprises a cured product obtained from a condensation product between a silyl acrylate compound and colloidal silica. The protective layer is effective in providing the photosensitive member with improved potential stability against a change in environmental conditions and an excellent durability.

15 Claims, 2 Drawing Sheets

ELECTROPHOTOGRAPHIC PHOTOSENSITIVE MEMBER AND ELECTROPHOTOGRAPHIC APPARATUS AND PROCESS CARTRIDGE INCLUDING SAME

FIELD OF THE INVENTION AND RELATED ART

The present invention relates to an electrophotographic photosensitive member (hereinafter simply referred to as "photosensitive member") including a specific protective layer and also relates to an electrophotographic apparatus and a process cartridge respectively including the photosensitive member.

Photosensitive members used in an electrophotographic process are generally required to have a given (photo-) sensitivity, electrical characteristics and optical characteristics suitable for the electrophotographic process applied. Particularly, in the case where a photosensitive member is used repetitively, on the photosensitive member, electrically and/or mechanically external force is directly exerted in respective steps, such as a charging step, an imagewise exposure step, a developing step with a toner, a transfer step onto a paper, and a cleaning step. Accordingly, the photosensitive member is required to have a durability with respect to such external forces.

More specifically, the photosensitive member is required to have resistances to abrasion or marring of its surface due to friction at the time of the transfer or cleaning, and resistance to deterioration thereof and in electrical characteristics due to ozone generated at the time of corona charging. Further, toner particles are attached to the surface of the photosensitive member due to repetition of development with the toner and the cleaning of the toner. Thus, the photosensitive member is required to have a good cleaning characteristic.

In order to satisfy the above-mentioned requirements, there has been proposed a surface protective layer formed on a photosensitive layer principally containing a resin in, e.g., Japanese Laid-Open Patent Applications (JP-A) 56-42863 and 53-103741. In the protective layer, a curable resin is used as a main component so as to improve the hardness and abrasion (or wear) resistance thereof.

Further, in order to obtain excellent images, the protective layer is also required to have an appropriate electrical resistance or resistivity in addition to a high hardness and an excellent abrasion resistance. In the case where the protective layer has a too high (electrical) resistance, the protective layer is liable to cause an increase in residual potential, i.e., a charge accumulation within the protective layer. As a result, electric potential is not stabilized at the time of repetitive use of the photosensitive member, thus resulting in an unstable image quality. In the case where the resistance of the protective layer is too low, an electrostatic latent image flows or moves in a planar direction within the protective layer, thus leading to an occurrence of image blur. In order to solve these problems, there has been proposed a method wherein metal oxide particles are added as electroconductive fine particles in a protective layer to appropriately control an electrical resistance of the resultant layer in, e.g., JP-A 57-30843. On the other hand, it has been generally known that an appropriate resistivity of the protective layer for the photosensitive member is in the range of $10^{10}$–$10^{15}$ ohm.cm.

However, with respect to a conventional protective layer having a resistivity (electrical resistance) within the above range, the resistance is liable to be largely changed depending on a change in environmental condition. Particularly, in a high-humidity environment, a lowering in resistivity of the protective layer is readily caused, thus resulting in image blur leading to lowered image quality as described above.

Thus, there still has not been provided a satisfactory protective layer for the photosensitive layer.

There have been proposed a curable acrylic resin for use in a protective layer of a photosensitive member in, e.g., JP-A 61-5253 and 1-178972. However, in such a protective layer, an electrical resistance thereof is liable to be largely affected by a change in environmental conditions since the acrylic resin has a polar group, such as carbonyl groups susceptible to humidity. Particularly, in a high humidity environment, a lowering in resistance of the protective layer is readily caused, thus resulting in an occurrence of image flow.

Further, there has also been proposed a protective layer containing colloidal silica in, e.g., JP-A 60-57847. However, the protective layer has a polar groups, such as hydroxyl group, so that the protective layer is readily affected by humidity similarly as in the case of the acrylic resin described above, thus leading to a problem of image flow.

SUMMARY OF THE INVENTION

An object of the present invention is to provide a photosensitive member with excellent stability against a change in environmental conditions, providing a high durability and low transfer memory and photo-memory, and free from an accumulation of residual potential in a repetitive electrophotographic (image forming) process.

Another object of the present invention is to provide an electrophotographic apparatus and process cartridge each including the photosensitive layer described above.

According to the present invention, there is provided an electrophotographic photosensitive member, comprising: at least a support, a photosensitive layer disposed on the support, and a protective layer disposed on the photosensitive layer, wherein the protective layer comprises a cured product obtained from a condensation product between a silyl acrylate compound and colloidal silica.

According to the present invention, there is also provided an electrophotographic apparatus, comprising: the electrophotographic photosensitive member described above, charging means for charging said photosensitive member, imagewise exposure means for exposing imagewise the charged photosensitive member to form an electrostatic latent image on the photosensitive member, and developing means for developing the latent image with a toner.

According to the present invention, there is further provided a process cartridge, comprising: the electrophotographic photosensitive member described above and charging means for charging the photosensitive member.

These and other objects, features and advantages of the present invention will become more apparent upon a consideration of the following description of the preferred embodiments of the present invention taken in conjunction with the accompanying drawings.

DETAILED DESCRIPTION OF THE DRAWINGS

Figure 1:
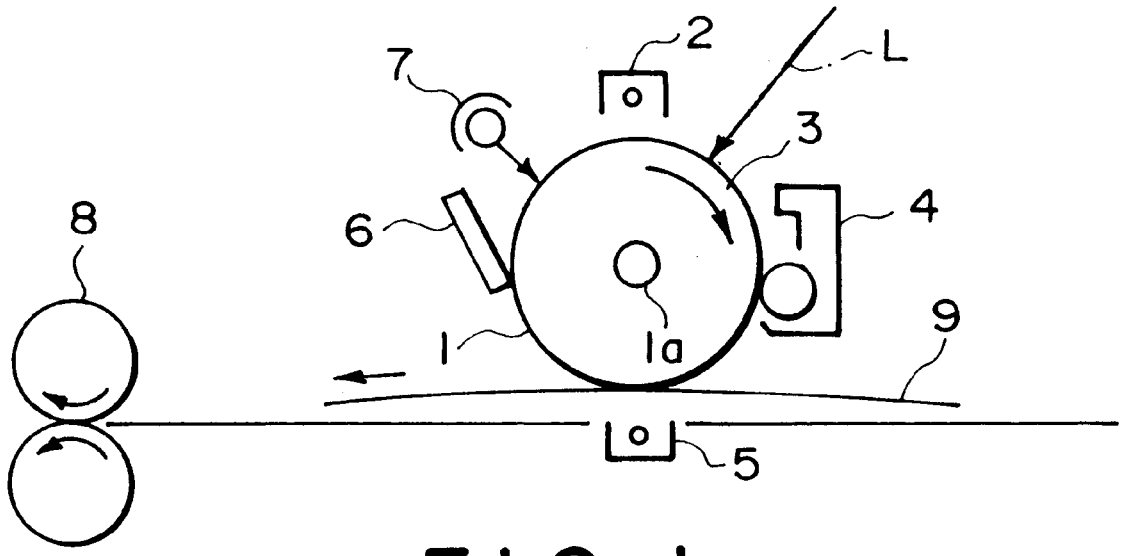
FIG. 1 is a schematic sectional view of an embodiment of an electrophotographic apparatus using the photosensitive member according to the present invention.

The photosensitive member according to the present invention including at least a support, a photosensitive layer disposed on the support and a protective layer disposed on the photosensitive layer is characterized by including a cured product constituting the protective layer. The cured product is obtained from a condensation product between a silyl acrylate compound and colloidal silica.

In the present invention, the silyl acrylate compound may have at least one alkoxysilyl group and at least one double bond in its molecular structure.

The alkoxysilyl group of the silyl acrylate compound may preferably contain 1–3 alkoxy groups, more preferably two or three alkoxy groups connected with silicon (Si) atoms. The silyl acrylate compound may preferably have an weight-average molecular weight of 200–500.

The silyl acrylate compound may preferably be represented by the following formula (1):

(1)

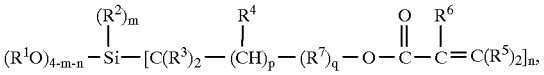

wherein $R^1$ denotes an alkyl group; $R^2$ denotes an alkyl group, an alkoxy group or an aryl group; $R^3$, $R^4$, $R^5$ and $R^6$ independently denote hydrogen atom, an alkyl group, an alkoxy group or an aryl group; $R^7$ denotes an alkylene group; m is an integer of 0–2 and n is an integer of 1–3 satisfying $0<m+n \leqq 3$; and p and q independently denote an integer of at least 0.

Each of the above groups for $R^1$ to $R^7$ including an alkyl group, an alkoxy group, an aryl group and an alkylene group may be substituted by a substituent. More specifically, examples of such a substituent may preferably include: an alkyl group, such as methyl, ethyl, propyl or butyl; an alkoxy group, such as methoxy, ethoxy, propoxy or butoxy; and a halogen atom, such as fluorine, chlorine or bromine.

Specific examples of the alkyl group for $R^1$–$R^6$ may preferably include methyl, ethyl, propyl and butyl. Specific examples of the alkoxy group for $R^2$–$R^6$ may preferably include methoxy, ethoxy, propoxy and butoxy. Further, the aryl group for $R^2$–$R^6$ may preferably be phenyl or naphthyl. The alkylene group for $R^7$ may preferably be methylene, ethylene or trimethylene.

Preferred examples of the silyl acrylate compound used in the present invention are shown below but the silyl acrylate compound usable in the present invention is not restricted to the following compounds.

Ex.Comp.No.

(1)

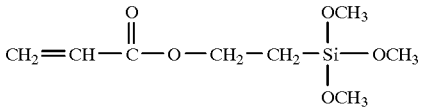

(2)

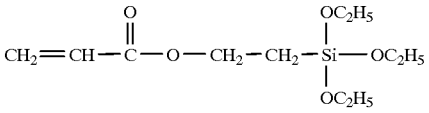

-continued (3)

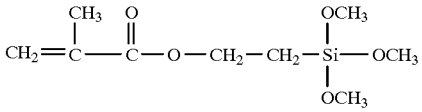

(4)

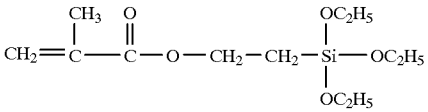

(5)

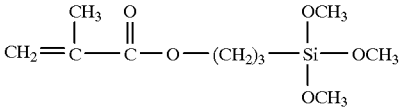

(6)

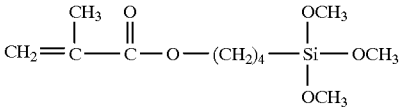

(7)

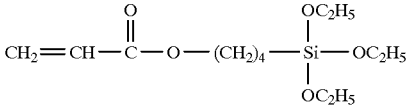

(8)

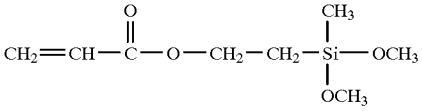

(9)

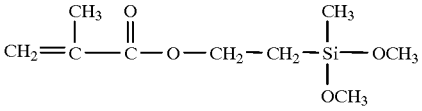

(10)

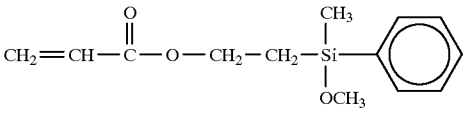

(11)

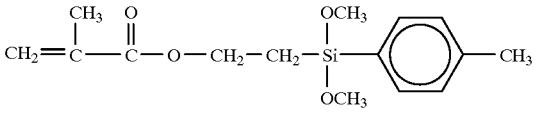

(12)

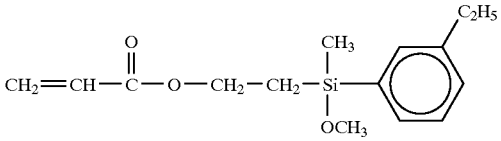

(13)

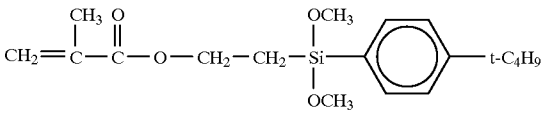

-continued (14)

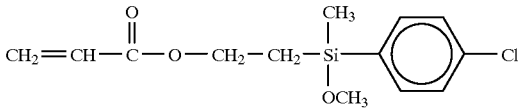

(15)

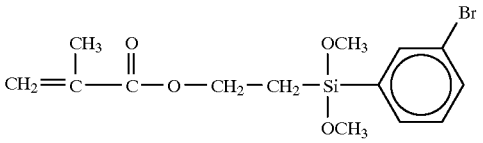

(16)

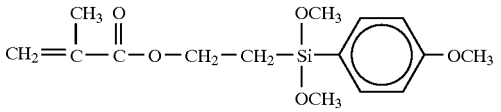

(17)

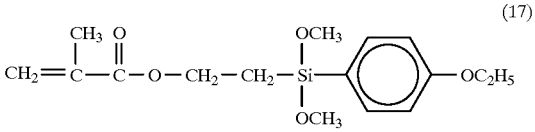

(18)

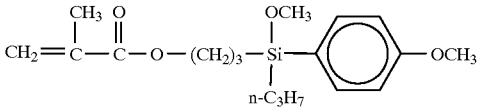

(19)

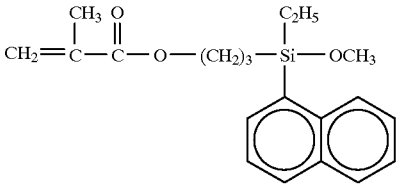

(20)

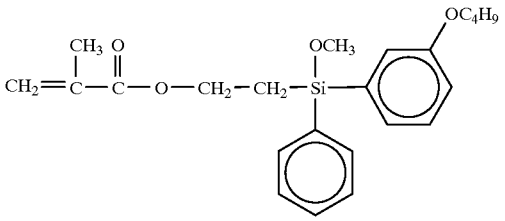

(21)

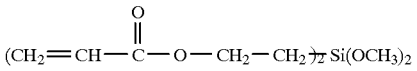

(22)

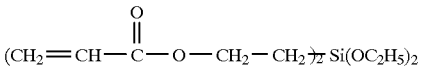

(23)

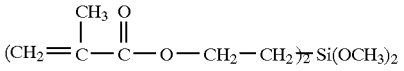

(24)

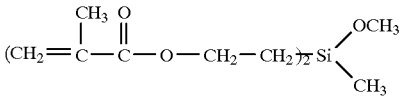

-continued (25)

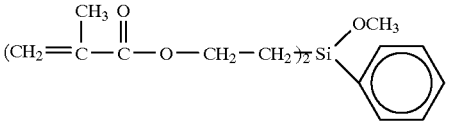

(26)

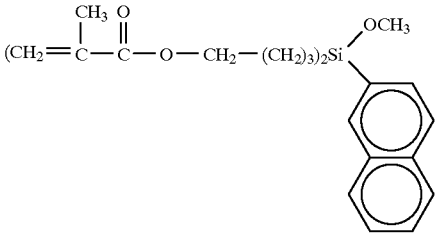

(27)

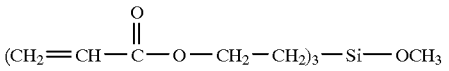

(28)

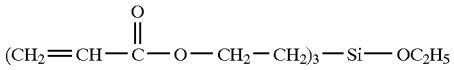

(29)

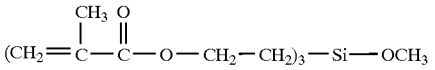

(30)

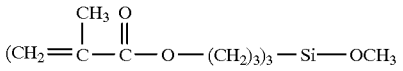

(31)

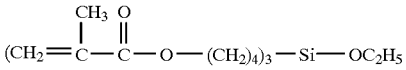

The colloidal silica used in the present invention comprises an aqueous dispersion liquid of silica ($SiO_2$) particles having hydroxyl groups at their surfaces due to hydration as is well known in the art. Such silica particles may preferably have an average particle size of 1 nm–1 $\mu$m.

In the present invention, the condensation product between the silyl acrylate compound and colloidal silica may be produced at room temperature or under heating through a condensation reaction after hydrolysis of the silyl acrylate compound in the presence of the (hydrous) colloidal silica and a water-miscible (soluble) alcohol or after the addition of the (hydrous) colloidal silica to a hydrolyzed product of the silyl acrylate compound. At that time, the silyl acrylate compound and the colloidal silica may preferably used in a ratio (silyl acrylate:colloidal silica) of 1:5 to 1:20 by weight.

The above-prepared condensation product may generally be a photocurable (light-curable) monomer containing an acrylic monomer portion modified by a water-repellent siloxane structure and hydrophobic silica. Accordingly, the cured product, obtained by curing such a photocurable monomer (condensation product), constituting the protective layer of the photosensitive member according to the present invention has an improved water-repellency and is little affected by humidity based on the condensation structure between the hydroxyl group located at the colloidal silica surface and the alkoxy silane portion. Further, the resultant protective layer is very effective in improving a transfer memory characteristic (i.e., a lowering in transfer memory specifically described hereinafter) of the photosensitive member of the present invention.

Incidentally, there has been known that a hydrolysis product between colloidal silica and a silyl acrylate can be used as a component of a coating composition (U.S. Pat. No. 4,455,205). On the other hand, in the present invention, the cured product obtained from the above-described condensation product between the silyl acrylate compound and colloidal silica is used for constituting a protective layer of a photosensitive member, whereby the resultant photosensitive member is improved in transfer memory characteristic as described above.

When the condensation product described above is cured, a photopolymerization initiator may generally be used in an appropriate amount, preferably 0.1–40 wt. %, particularly 0.5–20 wt. %, based on the entire condensation product.

Preferred examples of the photopolymerization initiator may include those shown below.

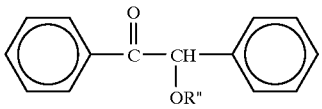

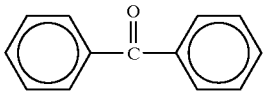

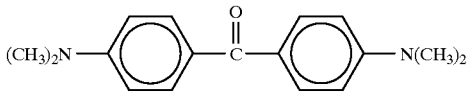

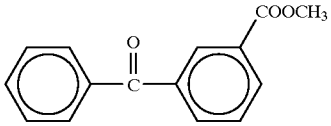

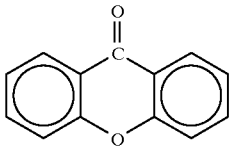

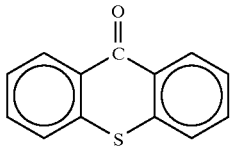

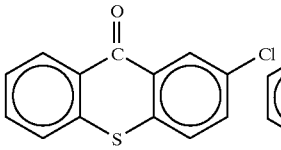

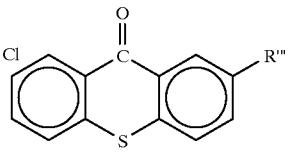

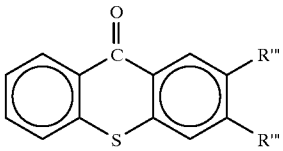

R'" = isopropyl, methyl, or ethyl

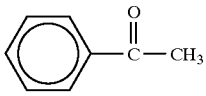

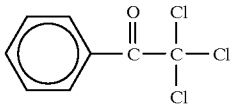

-continued

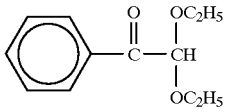

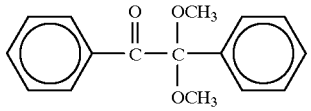

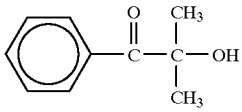

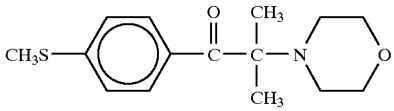

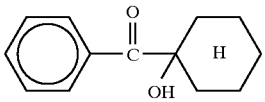

In the present invention, it is preferred that a polyfunctional acrylic monomer is cured together with the condensation product in view of the dense structure of a resultant film (cured product) in a mixing ratio (silyl acrylate: polyfunctional acrylic monomer) of 1:0.1–1:9 by mole.

Specific but non-exhaustive examples of the polyfunctional acrylic monomer may include those shown below.

Monomer No.

<1>

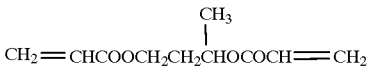

<2>

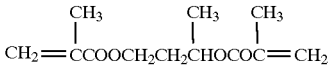

<3>

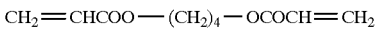

<4>

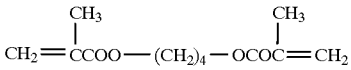

<5>

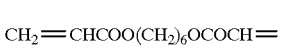

<6>

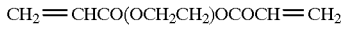

<7>

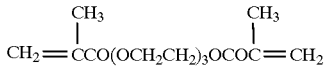

-continued
<8>
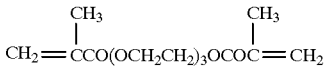
<9>
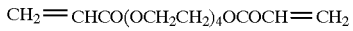
<10>
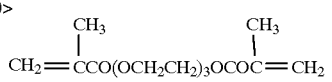
<11>
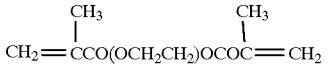
<12>
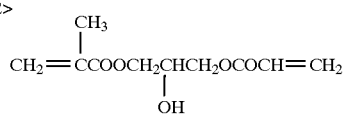
<13>
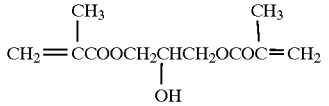
<14>
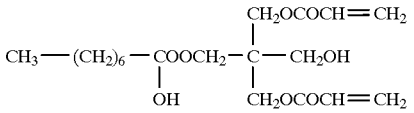
<15>
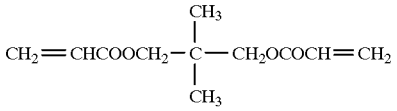
<16>
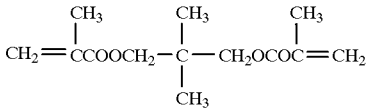
<17>
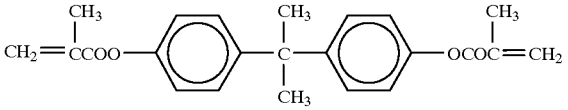
<18>
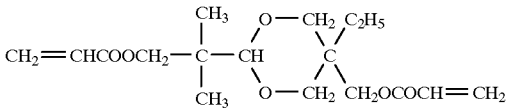
<19>
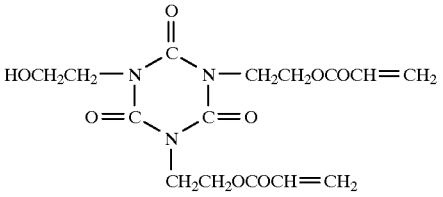
-continued
<20>
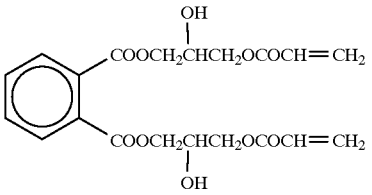
<21>
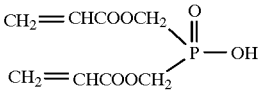
<22>
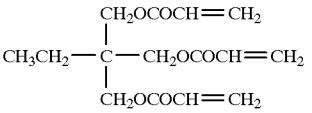
<23>
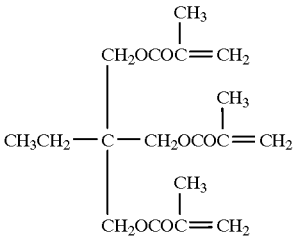
<24>
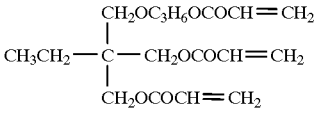
<25>
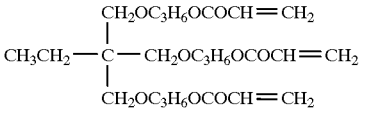
<26>
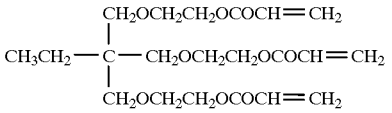
<27>
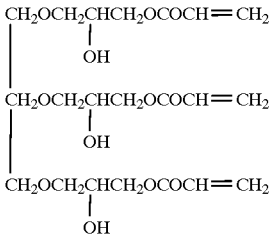
<28>
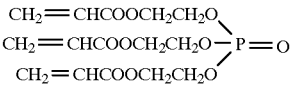

-continued

<29>

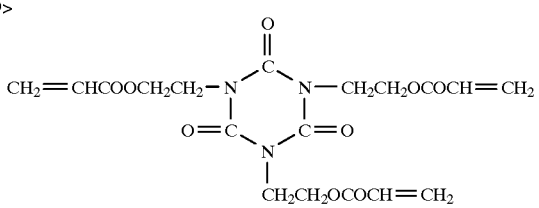

<30>

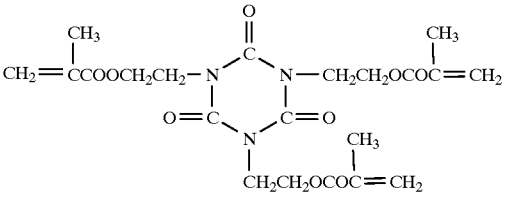

<31>

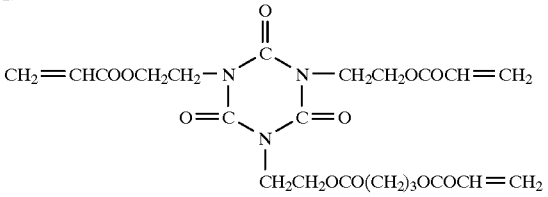

<32>

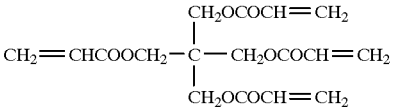

<33>

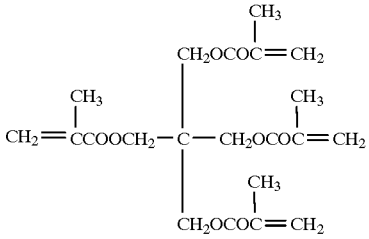

<34>

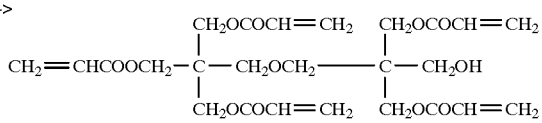

<35>

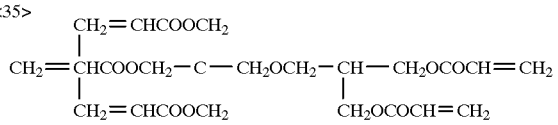

<36>

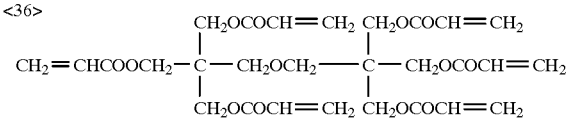

<37>

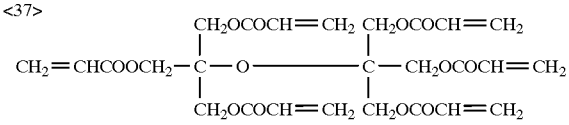

-continued

<38>

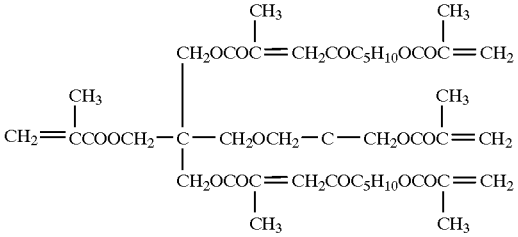

In the photosensitive member of the present invention, the protective layer may preferably have a volume resistivity of $10^{10}$–$10^{15}$ ohm.cm. In order to control the volume resistance of the protective layer so as to provide a value within the above range, electroconductive particles may be added in an appropriate amount, preferably 10–70 wt. %, per the protective layer.

Examples of the electroconductive particles may include particles of metal oxides, such as zinc oxide, titanium oxide, tin oxide, antimony oxide, bismuth oxide, tin-doped indium oxide, antimony-doped tin oxide, and zirconium oxide.

These metal oxide particles may be used singly or in combination of two or more species.

The electroconductive particles may have an average particle size of at most 0.3 $\mu$m, preferably at most 0.1 $\mu$m. The particle size of the electroconductive particles may preferably be as small as possible but may generally be 10 nm or above.

The protective layer used in the present invention may further contain various coupling agents and antioxidants in order to further improve, e.g., a dispersibility, an adhesiveness and an environmental resistance.

The protective layer may preferably have a thickness of 0.1–10 $\mu$m, particularly 0.5–7 $\mu$m.

The photosensitive layer of the photosensitive member of the present invention may have a single layer structure and a lamination layer structure of two or more layers. In the present invention, the photosensitive layer may preferably have a lamination structure including a lower charge generation layer (disposed on the support) and an upper charge transport layer (disposed on the charge generation layer) since such a lamination structure is effective in improving a (photo-)sensitivity and memory characteristics, such as a photomemory, of the resultant photosensitive member. Further, the photosensitive layer may have a lamination structure including a lower charge transport layer and an upper charge generation layer.

The charge generation layer may be formed by applying a dispersion of a charge generation material in a binder resin together with an appropriate solvent, followed by drying.

The thus-formed charge generation layer may preferably have a thickness of at most 5 $\mu$m, particularly 0.05–2 $\mu$m.

Examples of the charge generation material for the charge generation layer may include: azo pigments, quinone pigments, such as pyrenequinone an anthroquinone; quinocyanine pigments; perylene pigments; indigo pigments, such as indigo and thioindigo; azulenium salt pigments; and phthalocyanine pigments, such as copper phthalocyanine and titanyl phthalocyanine. Examples of the binder resin for the charge generation layer may include polyvinyl butyral, polystyrene, polyvinyl acetate, acrylic resin, cellulose acetate and ethyl cellulose.

The charge generation material may preferably be contained in the charge generation layer in an amount of 20–80 wt. %, more preferably 30–70 wt. %.

The charge transport layer may be formed by applying a dispersion of a charge transport material in a binder resin together with an appropriate solvent, followed by drying.

The thus-formed charge transport layer may preferably have a thickness of at most 5–40 $\mu$m, particularly 5–30 $\mu$m.

Examples of the charge transport material for the charge transport layer may include: polycyclic aromatic compounds having a cyclic structure, such as biphenylene, anthracene or phenanthrene, in a main or side chain; nitrogen-containing cyclic compounds, such as indoles, carbazoles, oxadiazoles and pyrazolines; hydrazone compounds; styryl compounds; and triarylamine compounds. Examples of the binder resin for the charge transport layer may include polyester, polycarbonate, polystyrene, and polymethacrylate.

The charge transport material may preferably be contained in the charge transport layer in an amount of 20–80 wt. %, more preferably 30–70 wt. %.

The charge transport layer may be formed by using a coating liquid comprising a solution of a polysilane preferably represented by the formula (2) shown below in an appropriate solvent (e.g., dichloromethane, chloroform).

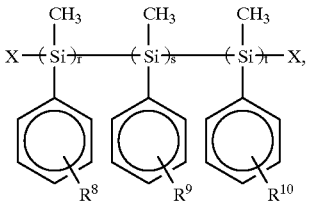

Formula (2)

In the formula (2), $R^8$, $R^9$ and $R^{10}$ independently denote an alkyl group or an aryl group each optionally having a substituent; each X independently denotes an alkyl group optionally having a substituent, an alkoxy group optionally having a substituent, an aryl group optionally having a substituent, or a halogen atom; and r, s and t independently denote an integer of at least 0 satisfying r+s+t>10.

Specific examples of the alkyl group for $R^8$ $R^9$, $R^{10}$ and X may preferably include methyl, ethyl and propyl. Specific examples of the aryl group for $R^8$ $R^9$, $R^{10}$ and X may preferably include phenyl and naphthyl. Further, the alkoxy group for X may preferably be methoxy, ethoxy, and propoxy. Further, the halogen atom for X may preferably be fluorine, chlorine or bromine.

Examples of the substituent for $R^8$–$R^{10}$ and X may preferably include: an alkyl group, such as methyl, ethyl or propyl; an alkoxy group, such as methoxy, ethoxy or propoxy and a halogen atom, such as fluorine, chlorine or bromine.

Specific some examples of the polysilane represented by the above formula (2) usable in the charge transport layer are shown below.

[1]

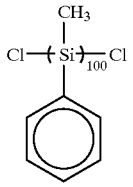

[2]

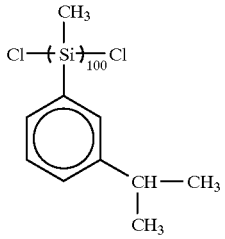

[3]

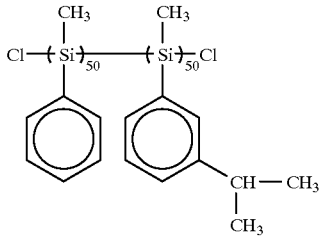

[4]

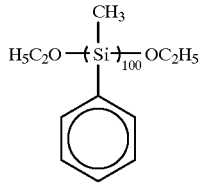

[5]

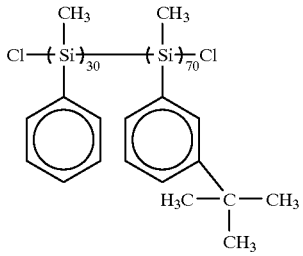

[6]

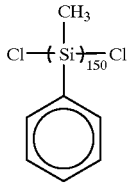

The polysilane of the formula (2) may generally be prepared through, e.g., Wurtz synthesis.

The polysilane has a high mobility, whereby it is effective for enhancing memory characteristics, such as a photomemory characteristic.

In the present invention, the protective layer of the photosensitive member has a relatively higher density of an acrylic portion, so that a somewhat insufficient cure can be caused therein in some cases if a charge transport layer is constituted by an ordinary charge transport material and a binder resin. In this regard, the polysilane does not cause migration of a low-molecular component leading to the insufficient cure state, so that the polysilane-based charge transport layer is effective in combination with the protective layer containing colloidal silica modified so as to have a high density of an acrylic portion at its surface as used in the present invention.

In the case where the photosensitive member of the present invention includes a photosensitive layer having a single layer structure, the photosensitive layer may, e.g., be formed by dissolving or dispersing a charge generation material (e.g., oxytitanium phthalocyanine or bisazo pigment), a charge transport material and a binder resin in an appropriate solvent, applying the solution or dispersion by a known coating method, and drying the wet coating. The thus-formed photosensitive layer having a single layer structure may preferably have a thickness of 5–40 $\mu$m, more preferably 10–30 $\mu$m.

The support constituting the photosensitive member according to the present invention may include any electroconductive material. Examples of the material for the support may include: a drum or sheet-shaped metal or alloy comprising aluminum, aluminum alloy, copper, chromium, nickel, zinc and/or stainless steel; a laminated plastic film covered with a metal foil of aluminum, copper, etc.; a plastic film covered with aluminum, indium oxide, tin oxide, etc., by vapor deposition; and metal, plastic film or paper each covered with an electroconductive layer formed by applying a coating liquid comprising an electroconductive substance and an optional appropriate binder and/or solvent as desired.

In the present invention, the support may preferably be in the form of a cylinder or drum, or a belt but may be formed in any shape suitable for an electrophotographic apparatus used.

In the present invention, it is possible to dispose an undercoat (or primer) layer having a barrier function controlling charge injection and an adhesive function at a boundary between the support and the photosensitive layer.

The undercoat layer principally comprises a binder resin and may optionally contain metal, alloy, their oxides, salts and a surfactant. Examples of such binder resin for the undercoat layer may include polyester, polyurethane, polyacrylate, polyethylene, polybutadiene, polycarbonate, polyamide, polypropylene, polyimide, phenolic resin, acrylic resin, silicone resin, epoxy resin, urea resin, allyl resin, alkyd resin, polyamide-imide, polysulfone, polyarylether, polyacetal and butyral resin.

The undercoat layer used in the present invention may preferably have a thickness of 0.05–7 $\mu$m, particularly 0.1–2 $\mu$m.

In the present invention, the above-mentioned various layers constituting the photosensitive member may generally be formed by vapor deposition or coating method. The coating method may preferably be used since the method allows a desired layer thickness (from a thin film to a thick film) and various layer compositions. Examples of such a coating method may include dipping, spray coating, beam coating, (wire) bar coating, and blade coating.

The photosensitive member according to the present invention can be applied to not only an ordinary electrophotographic apparatus such as a copying machine, but also a laser beam printer, a light-emitting diode (LED) printer, a cathode-ray tube (CRT) printer, a liquid crystal printer, a facsimile machine, and other fields of applied electrophotography including, e.g., laser plate making.

The photosensitive member according to the present invention may be prepared, e.g., as follows.

Onto an aluminum cylinder, a solution of a material for an undercoat layer in an appropriate solvent is applied to form an undercoat layer. On the undercoat layer, a charge generation layer and a charge transport layer are successively formed in the above-described manner.

Then, a mixture of a silyl acrylate compound, colloidal silica and water-miscible solvent (e.g., butanol) is heated and thereafter cooled to effect condensation reaction. The condensation product is further mixed with a polyfunctional acrylic monomer and electroconductive particles to prepare a coating liquid for a protective layer.

The coating liquid is applied onto the above-formed charge transport layer, followed by curing of the coating (e.g., by irradiation of light using a high-pressure mercury lamp) to prepare a photosensitive member according to the present invention.

Hereinbelow, an electrophotographic apparatus using the photosensitive member according to the present invention will be described.

FIG. 1 shows a schematic structural view of an embodiment of the electrophotographic apparatus using the photosensitive member of the invention. Referring to FIG. 1, a drum-shaped photosensitive member (photosensitive drum) 1 is rotated about an axis 1*a* at a prescribed peripheral speed in the direction of the arrow shown inside of the photosensitive drum 1. The surface of the photosensitive drum 1 is uniformly charged by means of a charger (charging means) 2 to have a prescribed positive or negative potential. Then, the photosensitive drum 1 is exposed to light L (as by slit exposure or laser beam-scanning exposure) by using an imagewise-exposure means (not shown), whereby an electrostatic latent image corresponding to an exposure image is successively formed on the surface of the photosensitive drum 1. The electrostatic latent image is developed with a toner by a developing means 4 to form a toner image. The toner image is successively transferred to a recording material 9 which is supplied from a supply part (not shown) to a position between the photosensitive drum 1 and a transfer corona charger (transfer means) 5 in synchronism with the rotating speed of the photosensitive drum 1, by means of the transfer means 5. The recording material 9 with the transferred toner image thereon is separated from the photosensitive drum 1 to be conveyed to an image-fixing device (image-fixing means) 8, followed by image fixation to print out the recording material 9 as a copy product outside the electrophotographic apparatus. Residual toner particles remaining on the surface of the photosensitive drum 1 after the transfer are removed by means of a cleaner (cleaning means) 6 to provide a cleaned surface, and residual charge on the surface of the photosensitive drum 1 is erased by a pre-exposure means 7 to be subjected to next image formation.

Figure 2:
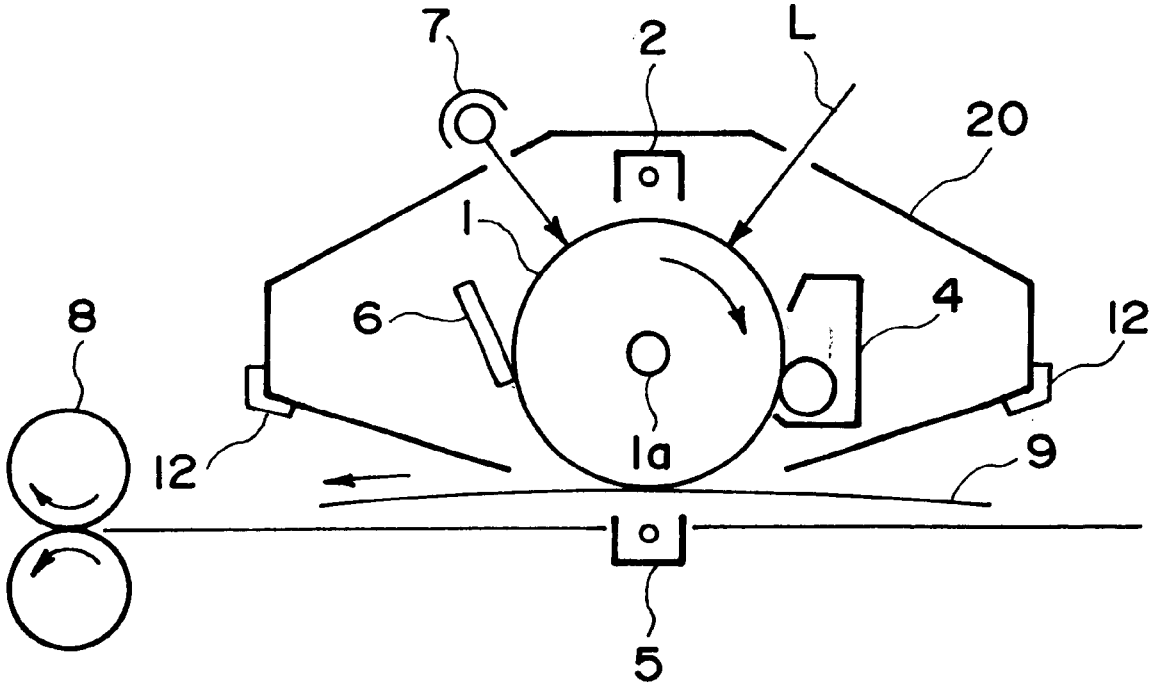
FIGS. 2–4 are schematic sectional views each illustrating another embodiment of the electrophotographic apparatus of the present invention, respectively.

In an electrophotographic apparatus shown in FIG. 2, at least three members comprising a photosensitive member 1, a charging means 2 and a developing means 4 are integrally supported to form a process cartridge 20, being attachable to or detachable from an apparatus body by using a guiding means 12 such as a rail within the apparatus body. In this case, a cleaning means 6 may be disposed within the cartridge 20.

Figure 3:
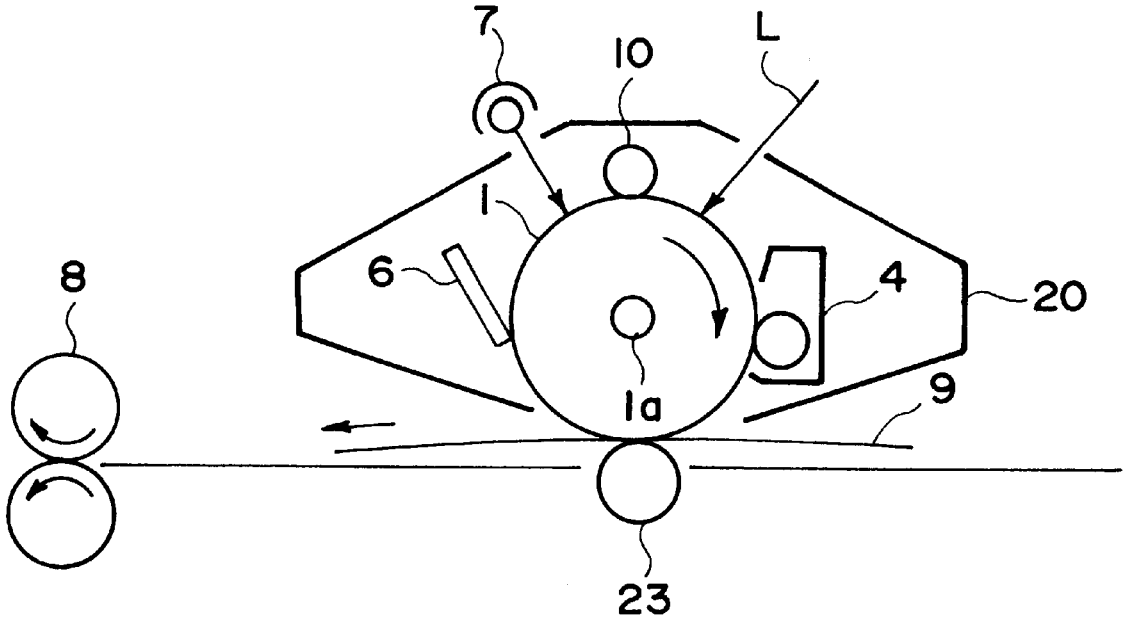
Figure 4:
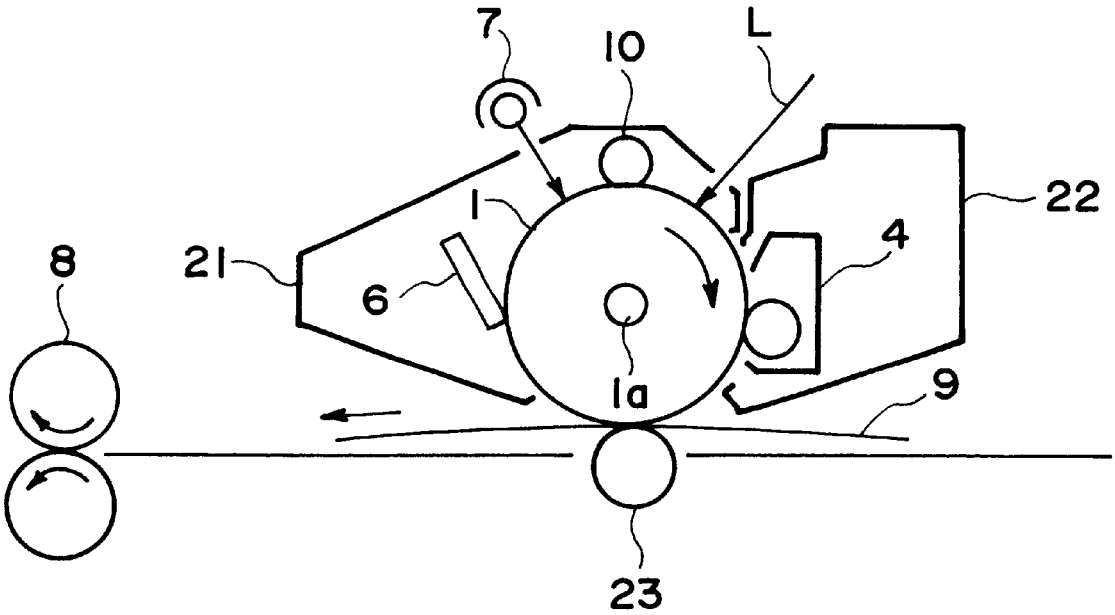

In FIGS. 3 and 4, a direct charging means 10 as a charging means is used for directly charging the photosensitive drum (member) 1. Specifically, the direct charging means 10 supplied with a voltage is caused to be come in contact with the photosensitive member 1 directly to effect direct charging of the photosensitive member 1. In electrophotographic apparatus shown in FIGS. 3 and 4, toner images formed on the photosensitive member 1 are transferred to a recording member 9 by a direct charging member 23. Specifically, a voltage-applied direct charging member 23 is caused to be in contact with the recording member 9 directly, thus transferring the toner images formed on the photosensitive member 1 onto the recording material 9.

In an electrophotographic apparatus shown in FIG. 4, a first process cartridge comprising at least two members of a photosensitive member 1 and a direct charging member 10 installed in a container 21 and a second process cartridge comprising at least a developing means 7 installed in a container 22 are respectively disposed attachably to or detachably from an apparatus body. In this case, a cleaning means 6 may be disposed within the first process cartridge 21.

In a case where the electrophotographic apparatus is used as a copying machine or a printer, imagewise exposure to light L may be performed by using reflection light or transmitted light from an original or by reading data on the original, converting the data into a signal and then effecting a laser beam scanning, a drive of LED array or a drive of a liquid crystal shutter array in accordance with the signal.

Hereinbelow, the present invention, will be explained more specifically with reference to examples. In the following, "part(s)" means "weight part(s)".

EXAMPLE 1

A solution of 10 parts of an alcohol-soluble nylon copolymer (weight-average molecular weight (Mw)=28000) and 30 parts of a methoxymethylated 6-nylon (Mw=30000) in a mixture solvent of 260 parts of methanol and 40 parts of butanol was applied onto an aluminum cylinder (outer diameter=30 mm, length=260 mm) by dipping, followed by drying for 10 minutes at 90° C. to form a 1 μm-thick undercoat layer.

A coating liquid for a charge generation layer was prepared by dispersing a mixture of 4 parts of a bisazo pigment of the formula:

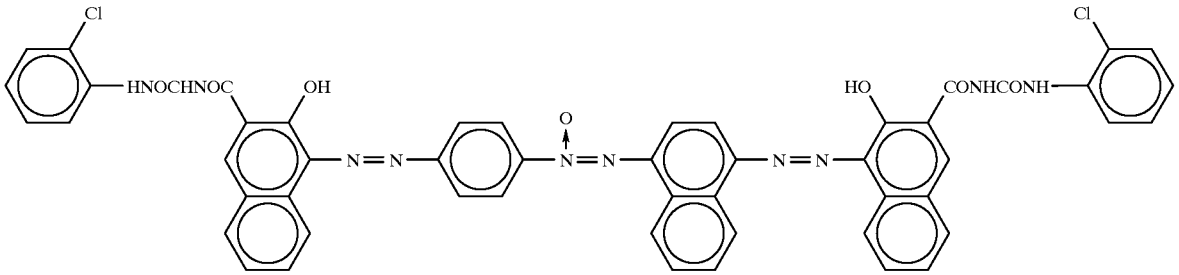

and 2 parts of a butyral resin (butyral degree=65 mole %, Mw=24000) in 100 parts of cyclohexanone by means of a sand mill for 30 hours and by adding 100 parts of tetrahydrofuran (THF) to the above mixture. The thus prepared coating liquid was applied onto the above prepared undercoat layer by dipping, followed by drying for 20 minutes at 80° C. to form a 0.3 μm-thick charge generation layer.

Onto the charge generation layer, a solution of 10 parts of a styryl compound of the formula:

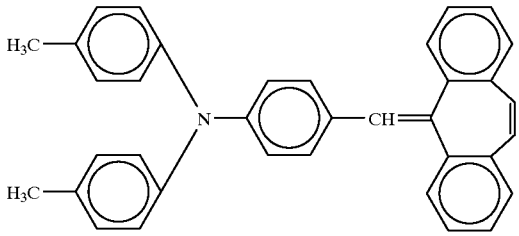

and 10 parts of a polycarbonate resin (Mw=40000) in a mixture solvent of 20 parts of dichloromethane and 60 parts of chlorobenzene was applied by dipping, followed by drying for 60 minutes at 120° C. to form a 20 μm-thick charge transport layer.

Then, a coating liquid for a protective layer was prepared as follows.

A mixture of 10 parts of a silyl acrylate compound (Ex. Comp. No. (1)), 100 parts of a colloidal silica ("Nalcoag 1034A", mfd. by Nalco Chemical Company) and 300 parts of t-butanol was heat-refluxed for 5 min. After cooling, 25 parts of a mixture liquid of 1,4-butanediol diacrylate/propylene oxide-modified trimethylolpropane triacrylate (1/1) was added to the above-refluxed mixture, followed by distilling-off of the solvent under reduced pressure to obtain a clear solution. In 100 parts of the solution (mixture), 2 parts of 2,2-diethoxyacetophenone and 50 parts of 10 wt. %-antimony-containing tin oxide fine particles (average particle size=0.02 μm) were added and mixed to prepare a coating liquid.

The thus prepared coating liquid was applied onto the charge transport layer by spray coating and dried, followed by ultraviolet ray irradiation for 30 seconds with a high-pressure mercury lamp at a light intensity of 80 mW/cm$^2$ to form a 3 μm-thick protective layer, thus preparing a photosensitive member according to the present invention.

The thus prepared photosensitive member was installed in a copying machine ("NP-3825", mfd. by Canon K.K.) remodeled so as to evaluate electrophotographic characteristics, thus measuring several electrophotographic properties including dark part potential $V_D$ (V), sensitivity $E_{\Delta 500}$ (lux.sec) and residual potential $V_r$ (V) in a normal temperature/normal humidity environment (23° C./50%RH: abbreviated s "N/N condition").

In this regard, a larger "dark part potential" represents a better chargeability. Further, "sensitivity" is evaluated as a quantity of light ($E_{\Delta 500}$; lux.sec) required for decreasing (or attenuating) a surface potential of −700 V to a surface potential of −200 V.

The results are shown in Table 1 appearing hereinafter.

Then, the copying machine including the photosensitive member was subjected to image formation at an initial stage under environmental conditions including N/N condition (23° C./50%RH), low-temperature/low-humidity environment (10° C./15%RH) (abbreviated as "L/L" condition), and high-temperature/high-humidity environment (35° C./85%RH) (abbreviated as "H/H condition") to evaluate image forming properties by sight. Further, the copying machine was subjected to successive image formation of 100,000 sheets (a durability test) under N/N condition. The results are shown in Table 2 appearing hereinafter.

Separately, a photosensitive member was prepared in the same manner as in the above-prepared photosensitive member and was subjected to successive image formation of 100,000 sheets under N/N condition to measure dark part potentials ($V_D$) and light part potentials ($V_L$) at an initial stage (initial $V_D$=−1010 V, initial $V_L$=−200 V) and after the copying of $10^5$ sheets thus evaluating differences therebetween respectively, as a fluctuation in dark part potential ($\Delta V_D$) and a fluctuation in light part potential ($\Delta V_L$). The results are also shown in Tables 1 and 2.

As apparent from the results shown in Tables 1 and 2 (appearing hereinafter), good images free from image irregularity and black spots were obtained. Further, the potential fluctuations $\Delta V_D$ and $\Delta V_L$ were decreased and stable images were retained even after the copying of $10^5$ sheets.

Further, with respect to the photosensitive member prepared in this example, a photomemory characteristic and a transfer memory characteristic were evaluated in the following manners, respectively.

Measurement of a photomemory was performed under N/N condition as follows.

A part of the photosensitive member surface was covered with a masking (light-intercepting) member and the photosensitive member was exposed to (irradiated by) a white fluorescent lamp (illuminance=2000 lux) for 15 min. Thereafter, the photosensitive member was left standing for 10 min., followed by measurement of a voltage at the irradiated portion and a voltage at the covered (unexposed) portion.

A photomemory (V) was evaluated as a difference between the voltages at the irradiated and covered portions.

Measurement of a transfer memory was performed under N/N condition as follows.

With respect to the photosensitive member, a primary-charge voltage $V_{d1}$ under no transfer current application and a primary-charge voltage $V_{d2}$ under application of a transfer current were measured to determine a difference therebetween (as absolute value) as a transfer memory (V).

The results are also shown in Table 1.

EXAMPLES 2–5

Four photosensitive members were prepared and evaluated in the same manner as in Example 1 except for using silyl acrylate compounds (Ex. Comp. Nos. (3), (5), (10) and (23) for Examples 2–5, respectively) instead of the silyl acrylate compound (Ex. Comp. No. (1)), respectively.

The results are shown in Tables 1 and 2.

COMPARATIVE EXAMPLE 1

A photosensitive member was prepared and evaluated in the same manner as in Example 1 except that the protective layer was not formed.

The results are shown in Tables 1 and 2.

The photosensitive member showed good electrophotographic properties at an initial stage but lowered its chargeability, thus failing to provide good image due to an occurrence of black spots at the time of the copying of about $5\times10^4$ sheets.

COMPARATIVE EXAMPLE 2

A photosensitive member was prepared and evaluated in the same manner as in Example 1 except that a 3 μm-thick protective layer was formed in the following manner.

A coating liquid for the protective layer was prepared by mixing a mixture of 10 parts of an acrylic monomer ($CH_2$=CH—COO—$CH_2$—$CH_3$), 100 parts of a colloidal silica ("Nalcoag 1034A", the same as in Example 1), 2 parts of 2,2-diethoxyacetophenone, 100 parts of 0.02 μm-dia. antimony-containing tin oxide fine particles (the same as in Example 1) and 300 parts of t-butanol in a sand mill for 48 hours.

The results are shown in Tables 1 and 2.

The photosensitive member caused image flow in H/H condition and, in the successive image forming test (durability test), provided a larger $\Delta V_L$ (light part potential charge) and caused fogging.

TABLE 1

Electrophotographic properties

| Ex. No. | $V_D$ (−V) | $E_{\Delta500}$ (lux · sec) | Vr (−V) | $\Delta V_D$ (V) | $\Delta V_L$ (V) | Photo-memory (V) | Transfer memory (V) |
|---|---|---|---|---|---|---|---|
| Ex. | | | | | | | |
| 1 | 1010 | 1.8 | 20 | 0 | 10 | 10 | 10 |
| 2 | 1020 | 1.8 | 20 | 10 | 15 | 20 | 5 |
| 3 | 1020 | 1.9 | 15 | 10 | 10 | 10 | 10 |
| 4 | 1020 | 1.8 | 25 | 0 | 10 | 20 | 15 |
| 5 | 1015 | 1.8 | 15 | 5 | 20 | 15 | 15 |
| Comp. Ex. | | | | | | | |
| 1 | 980 | 1.6 | 10 | * | * | 15 | 10 |
| 2 | 1020 | 1.9 | 30 | 20 | 100 | 50 | 60 |

*: charging failure occurred.

TABLE 2

Image forming properties

| Ex. No. | (N/N) Initial | (N/N) $10^5$ sheets | (L/L) Initial | (H/H) Initial |
|---|---|---|---|---|
| Ex. | | | | |
| 1 | Good | Good | Good | Good |
| 2 | " | " | " | " |
| 3 | " | " | " | " |
| 4 | " | " | " | " |
| 5 | " | " | " | " |
| Comp. Ex. | | | | |
| 1 | Good | — | Good | Image flow |
| 2 | " | Fog | " | " |

EXAMPLE 6

A coating liquid for an electroconductive layer was prepared as follows.

A mixture of 50 parts of electroconductive titanium oxide powder coated with 10 wt. %-antimony oxide-containing tin oxide (average primary particle size (of the powder)=0.3 μm, coating amount=35 wt. %), 25 parts of a phenolic resin, 20 parts of methyl cellosolve, 20 parts of methanol and 0.002 part of a silicone oil (polydimethylsiloxane-polyoxyalkylene copolymer, M=3000) was dispersed in a sand mill using 1 mmϕ-glass beads.

The thus prepared coating liquid was applied onto an aluminum cylinder (outer diameter=30 mm, length=260 mm) by dipping, followed by drying for 30 min. at 140° C. to form a 20 μm-thick electroconductive layer.

On the electroconductive layer, a 1 μm-thick undercoat layer was formed in the same manner as in Example 1.

Then, a coating liquid for a charge generation layer was prepared by dispersing a mixture of 4 parts of a bisazo pigment of the formula:

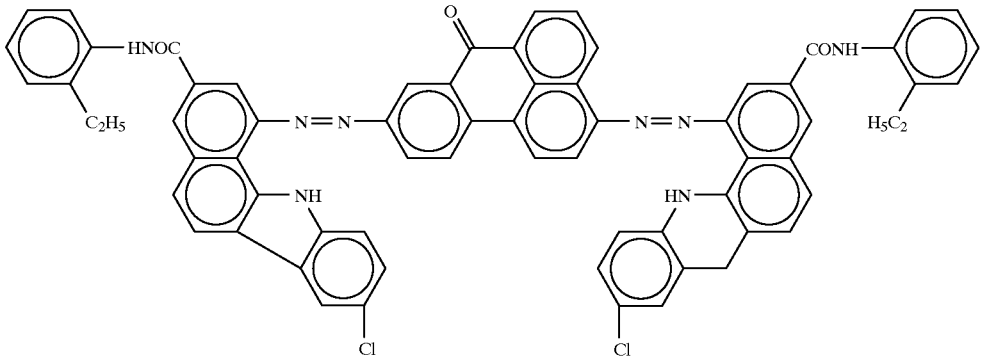

and 2 parts of polyvinylbenzal (benzal degree=80 mole %, Mw=12000) in 30 parts of cyclohexanone in a sand mill using 1 mmϕ-glass beads for 25 hours and by adding 60 parts of methylethylketone to the above mixture. The thus prepared coating liquid was applied onto the above prepared undercoat layer by dipping, followed by drying for 10 minutes at 80° C. to form a 0.3 μm-thick charge generation layer.

On the charge generation layer, a 20 μm-thick charge transport layer was prepared in the same manner as in Example 1.

Thereafter, on the charge transport layer, a protective layer was formed in the same manner as in Example 1 except that the thickness (3 μm) of the protective layer was changed to 5 μm, thus preparing a photosensitive member according to the present invention.

The thus prepared photosensitive member was installed in a laser beam printer ("Laser Shot 4 plus", mfd. by Hewlett-Packard Company) remodeled so as to evaluate electrophotographic characteristics and evaluated in the same manner as in Example 1.

The results are shown in Tables 3 and 4 appearing hereinafter.

As a result, the photosensitive member provided stable images free from image flow and image irregularity even in H/H condition and was excellent in potential stability due to decreased fluctuations in potentials in the successive image forming test.

EXAMPLES 7–10

Four photosensitive members were prepared and evaluated in the same manner as in Example 6 except for using silyl acrylate compounds (Ex. Comp. Nos. (4), (7), (11) and (22) for Examples 7–10, respectively) instead of the silyl acrylate compound (Ex. Comp. No. (1)), respectively.

The results are shown in Tables 3 and 4.

TABLE 3

| | Electrophotographic properties | | | | | | |
|---|---|---|---|---|---|---|---|
| Ex. No. | $V_D$ (−V) | $E_{\Delta 500}$ (lux · sec) | Vr (−V) | $\Delta V_D$ (V) | $\Delta V_L$ (V) | Photo-memory (V) | Transfer memory (V) |
| Ex. | | | | | | | |
| 6 | 850 | 1.6 | 25 | 10 | 0 | 15 | 10 |
| 7 | 860 | 1.7 | 30 | 0 | −10 | 10 | 15 |
| 8 | 860 | 1.8 | 20 | 0 | −10 | 20 | 10 |
| 9 | 850 | 1.7 | 25 | 5 | −15 | 20 | 20 |
| 10 | 850 | 1.6 | 25 | 10 | −10 | 10 | 15 |

TABLE 4

| | Image forming properties | | | |
|---|---|---|---|---|
| | (N/N) | | (L/L) | (H/H) |
| Ex. No. | Initial | $10^5$ sheets | Initial | Initial |
| Ex. | | | | |
| 6 | Good | Good | Good | Good |
| 7 | " | " | " | " |
| 8 | " | " | " | " |
| 9 | " | " | " | " |
| 10 | " | " | " | " |

EXAMPLE 11

On an aluminum cylinder (outer diameter=30 mm, length=260 mm), a 1 μm-thick undercoat layer was formed in the same manner as in Example 1.

Then, on the undercoat layer, a 18 μm-thick charge transport layer was formed in the same manner as in Example 1.

A 0.4 μm-thick charge generation layer was formed on the charge transport layer in the same manner as in Example 1.

Thereafter, on the charge generation layer, a 3 μm-thick protective layer was formed in the same manner as in Example 1, thus preparing a photosensitive member according to the present invention.

The thus prepared photosensitive member was evaluated in the same manner as in Example 1 by using a copying machine ("NP-3825", mfd. by Canon K.K.) remodeled so as to positively charge the photosensitive member.

The results are shown in Tables 5 and 6 appearing hereinafter.

As a result, the photosensitive member provided stable images free from image irregularity and black spots and decreased potential fluctuations ($\Delta V_D$ and $\Delta V_L$) and retained the stable images even when subjected to the copying of $10^5$ sheets.

EXAMPLE 12

A photosensitive member was prepared and evaluated in the same manner as in Example 11 except that the silyl acrylate compound for forming the coating liquid for the protective layer was changed to a silyl acrylate compound (Ex. Comp. No. (6)).

The results are shown in Tables 5 and 6.

EXAMPLE 13

A photosensitive member was prepared and evaluated in the same manner as in Example 11 except that the silyl acrylate compound was changed to a silyl acrylate compound (Ex. Comp. No. (16)) and the (electroconductive) fine particles were changed to zinc oxide fine particles (average particle size of 0.1 $\mu$m) each for forming the coating liquid for the protective layer.

The results are shown in Tables 5 and 6.

EXAMPLE 14

A photosensitive member was prepared and evaluated in the same manner as in Example 11 except that the silyl acrylate compound was changed to a silyl acrylate compound (Ex. Comp. No. (17)) and the (electroconductive) fine particles were changed to titanium oxide fine particles (average particle size of 0.1 $\mu$m) each for forming the coating liquid for the protective layer.

The results are shown in Tables 5 and 6.

EXAMPLE 15

A photosensitive member was prepared and evaluated in the same manner as in Example 11 except that the silyl acrylate compound was changed to a silyl acrylate compound (Ex. Comp. No. (21)) and the (electroconductive) fine particles were changed to tin oxide fine particles (average particle size of 0.2 $\mu$m) each for forming the coating liquid for the protective layer.

The results are shown in Tables 5 and 6.

COMPARATIVE EXAMPLE 3

A photosensitive member was prepared and evaluated in the same manner as in Example 11 except that the protective layer was not formed.

The results are shown in Tables 5 and 6.

The photosensitive member showed good electrophotographic properties at an initial stage but caused an occurrence of abrasion of the charge generation layer at the time of the copying of 400 sheets, thus failing to retain good images.

TABLE 5

| | Electrophotographic properties | | | | | | |
|---|---|---|---|---|---|---|---|
| Ex. No. | $V_D$ (−V) | $E_{\Delta 500}$ (lux · sec) | Vr (−V) | $\Delta V_D$ (V) | $\Delta V_L$ (V) | Photo-memory (V) | Transfer memory (V) |
| Ex. | | | | | | | |
| 11 | 1010 | 1.9 | 15 | 0 | 20 | 20 | 30 |
| 12 | 1015 | 1.8 | 20 | 0 | 15 | 30 | 20 |
| 13 | 1020 | 1.9 | 20 | 10 | 15 | 30 | 20 |
| 14 | 1020 | 1.9 | 20 | 10 | 10 | 20 | 30 |
| 15 | 1020 | 1.8 | 15 | 10 | 20 | 20 | 25 |
| Comp. Ex. | | | | | | | |
| 3 | 970 | 1.6 | 15 | * | * | 30 | 30 |

*: charging failure occurred.

TABLE 6

| | Image forming properties | | | |
|---|---|---|---|---|
| | (N/N) | | (L/L) | (H/H) |
| Ex. No. | Initial | $10^5$ sheets | Initial | Initial |
| Ex. | | | | |
| 11 | Good | Good | Good | Good |
| 12 | " | " | " | " |
| 13 | " | " | " | " |
| 14 | " | " | " | " |
| 15 | " | " | " | " |
| Comp. Ex. | | | | |
| 13 | Good | — | Good | Image flow |

—: Image defect occurred at the time of the copying of 400 sheets.

EXAMPLE 16

On an aluminum cylinder (outer diameter=30 mm, length=260 mm), a 1 $\mu$m-thick undercoat layer was formed in the same manner as in Example 1.

A coating liquid for a charge generation layer was prepared by mixing 4 parts of oxytitanium phthalocyanine (showing four main peaks at bragg angles (2θ±0.2 degree) of 9.0 degrees, 14.2 degrees, 23.9 degrees and 27.1 degrees in X-ray diffraction pattern based on CuKα characteristic X-ray), 2 parts of a polyvinyl butyral ("S-LEC BM2", mfd. by Sekisui Kagaku Kogyo K.K.) and 60 parts of cyclohexanone in a sand mill using 1 mmϕ-glass beads for 4 hours and by adding 100 parts of ethyl acetate to the mixture.

The thus prepared coating liquid was applied onto the undercoat layer by dipping to form a 0.3 $\mu$m-thick charge generation layer.

A coating liquid for a charge transport layer was prepared by dissolving 10 parts of a polysilane (viscosity-average molecular weight=13000) of the formula:

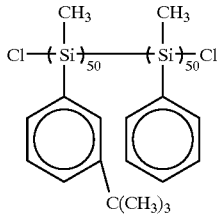

in a mixture solvent of 30 parts of toluene and 30 parts of THF and was applied onto the charge generation layer followed by drying for 1 hour at 120° C. to form a 10 μm-thick charge transport layer.

On the charge transport layer, a 3 μm-thick protective layer was formed in the same manner as in Example 1, thus preparing a photosensitive member according to the present invention.

The thus prepared photosensitive member was installed in a digital copying machine ("GP-55", mfd. by Canon K.K.) remodeled so as to evaluate electrophotographic characteristics and was evaluated in the same manner as in Example 1 except for evaluating sensitivity in the following manner.

In this example, "sensitivity" was evaluated as a light energy ($E_{\Delta 400}$; μJ/cm$^2$) required for decreasing (or attenuating) a surface potential of −500 V to a surface potential of −100 V.

The results are shown in Tables 7 and 8 appearing hereinafter.

As a result, the photosensitive member provided stable images free from image irregularity and black spots and decreased potential fluctuations ($\Delta V_D$ and $\Delta V_L$) and retained the stable images even when subjected to the copying of $10^5$ sheets.

EXAMPLES 17–20

Four photosensitive members were prepared and evaluated in the same manner as in Example 16 except for using silyl acrylate compounds (Ex. Comp. Nos. (3), (5), (10) and (23) for Examples 17–20, respectively) instead of the silyl acrylate compound (Ex. Comp. No. (1)), respectively.

The results are shown in Tables 7 and 8.

COMPARATIVE EXAMPLE 4

A photosensitive member was prepared and evaluated in the same manner as in Example 16 except that the protective layer was not formed.

The results are shown in Tables 7 and 8.

The photosensitive member showed good electrophotographic properties at an initial stage but lowered its chargeability, thus failing to provide good image due to an occurrence of black spots at the time of the copying of about 2000 sheets.

TABLE 7

| | Electrophotographic properties | | | | | | |
|---|---|---|---|---|---|---|---|
| Ex. No. | $V_D$ (−V) | $E_{\Delta 400}$ (μJ/cm$^2$) | Vr (−V) | $\Delta V_D$ (V) | $\Delta V_L$ (V) | Photo-memory (V) | Transfer memory (V) |
| Ex. | | | | | | | |
| 16 | 650 | 1.3 | 20 | 0 | 10 | 30 | 10 |
| 17 | 620 | 1.4 | 20 | 10 | 15 | 20 | 10 |

TABLE 7-continued

| | Electrophotographic properties | | | | | | |
|---|---|---|---|---|---|---|---|
| Ex. No. | $V_D$ (−V) | $E_{\Delta 400}$ (μJ/cm$^2$) | Vr (−V) | $\Delta V_D$ (V) | $\Delta V_L$ (V) | Photo-memory (V) | Transfer memory (V) |
| 18 | 550 | 1.6 | 15 | 0 | 10 | 20 | 20 |
| 19 | 570 | 1.5 | 15 | 0 | 10 | 25 | 10 |
| 20 | 580 | 1.4 | 15 | 5 | 20 | 20 | 15 |
| Comp. Ex. | | | | | | | |
| 4 | 450 | 1.1 | 10 | * | * | 25 | 20 |

*: charging failure occurred.

TABLE 8

| | Image forming properties | | | |
|---|---|---|---|---|
| | (N/N) | | (L/L) | (H/H) |
| Ex. No. | Initial | $10^5$ sheets | Initial | Initial |
| Ex. | | | | |
| 16 | Good | Good | Good | Good |
| 17 | " | " | " | " |
| 18 | " | " | " | " |
| 19 | " | " | " | " |
| 20 | " | " | " | " |
| Comp. Ex. | | | | |
| 4 | Good | — | Good | Good |

EXAMPLE 21

On an aluminum cylinder (outer diameter=30 mm, length=260 mm), a 20 μm-thick electroconductive layer was formed in the same manner as in Example 6 and thereon a 1 μm-thick undercoat layer was formed in the same manner as in Example 16.

On the undercoat layer, a 0.3 μm-thick charge generation layer was formed in the same manner as in Example 16.

A coating liquid for a charge transport layer was prepared by dissolving 10 parts of a polysilane (viscosity-average molecular weight=12500) of the formula:

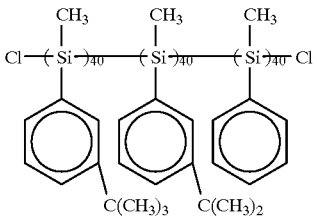

in a mixture solvent of 30 parts of toluene and 30 parts of THF and was applied onto the charge generation layer followed by drying for 1 hour at 120° C. to form a 12 μm-thick charge transport layer.

On the charge transport layer, a 5 μm-thick protective layer was formed in the same manner as in Example 16 except for changing the layer thickness, thus preparing a photosensitive member according to the present invention.

The thus prepared photosensitive member was evaluated in the same manner as in Example 16.

The results are shown in Tables 9 and 10 appearing hereinafter.

As a result, the photosensitive member provided stable images free from image irregularity and black spots even in H/H condition and decreased potential fluctuations ($\Delta V_D$ and $\Delta V_L$), thus being excellent in potential stability.

EXAMPLE 22

A photosensitive member was prepared and evaluated in the same manner as in Example 21 except that the silyl acrylate compound was changed to a silyl acrylate compound (Ex. Comp. No. (4)) and the (electroconductive) fine particles were changed to tin-doped indium oxide fine particles (average particle size of 0.1 μm) each for forming the coating liquid for the protective layer.

The results are shown in Tables 9 and 10.

EXAMPLE 23

A photosensitive member was prepared and evaluated in the same manner as in Example 21 except that the silyl acrylate compound was changed to a silyl acrylate compound (Ex. Comp. No. (7)) and the (electroconductive) fine particles were changed to tin oxide fine particles (average particle size of 0.3 μm) each for forming the coating liquid for the protective layer.

The results are shown in Tables 9 and 10.

EXAMPLE 24

A photosensitive member was prepared and evaluated in the same manner as in Example 21 except that the silyl acrylate compound was changed to a silyl acrylate compound (Ex. Comp. No. (11)) and the (electroconductive) fine particles were changed to antimony oxide fine particles (average particle size of 0.1 μm) each for forming the coating liquid for the protective layer.

The results are shown in Tables 9 and 10.

EXAMPLE 25

A photosensitive member was prepared and evaluated in the same manner as in Example 21 except that the silyl acrylate compound was changed to a silyl acrylate compound (Ex. Comp. No. (27)) and the (electroconductive) fine particles were changed to zirconium oxide fine particles (average particle size of 0.2 μm) each for forming the coating liquid for the protective layer.

The results are shown in Tables 9 and 10.

TABLE 9

| | Electrophotographic properties | | | | | | |
|---|---|---|---|---|---|---|---|
| Ex. No. | $V_D$ (−V) | $E_{\Delta 400}$ (μJ/cm²) | Vr (−V) | $\Delta V_D$ (V) | $\Delta V_L$ (V) | Photo-memory (V) | Transfer memory (V) |
| Ex. | | | | | | | |
| 21 | 650 | 1.1 | 25 | 10 | 0 | 20 | 10 |
| 22 | 650 | 1.2 | 30 | 0 | 0 | 25 | 10 |
| 23 | 620 | 1.1 | 20 | 0 | 0 | 20 | 20 |
| 24 | 630 | 1.2 | 25 | 5 | 0 | 20 | 10 |
| 25 | 640 | 1.3 | 25 | 10 | 0 | 30 | 15 |

TABLE 10

| | Image forming properties | | | |
|---|---|---|---|---|
| | (N/N) | | (L/L) | (H/H) |
| Ex. No. | Initial | $10^5$ sheets | Initial | Initial |
| Ex. | | | | |
| 21 | Good | Good | Good | Good |
| 22 | " | " | " | " |
| 23 | " | " | " | " |
| 24 | " | " | " | " |
| 25 | " | " | " | " |

What is claimed is:

1. An electrophotographic photosensitive member, comprising: at least a support, a photosensitive layer disposed on the support, and a protective layer disposed on the photosensitive layer, wherein said protective layer comprises a cured product obtained from a condensation product between a silyl acrylate compound and colloidal silica.

2. A member according to claim 1, wherein said silyl acrylate compound has at least one alkoxysilyl group and at least one double bond.

3. A member according to claim 1, wherein said silyl acrylate compound is represented by the following formula (1):

$$(R^1O)_{4-m-n}\overset{(R^2)_m}{\overset{|}{Si}}-[C(R^3)_2-\overset{R^4}{\overset{|}{(CH)_p}}-(R^7)_q-O-\overset{O}{\overset{\|}{C}}-\overset{R^6}{\overset{|}{C}}=C(R^5)_2]_n, \quad (1)$$

wherein R denotes an alkyl group; $R^2$ denotes an alkyl group, an alkoxy group or an aryl group; $R^3$, $R^4$, $R^5$ and $R^6$ independently denote hydrogen atom, an alkyl group, an alkoxy group or an aryl group; $R^7$ denotes an alkylene group; m is an integer of 0–2 and n is an integer of 1–3 satisfying $0<m+n\leqq 3$; and p and q independently denotes an integer of at least 0.

4. A member according to claim 1, wherein said cured product is obtained from said condensation product and a polyfunctional acrylic monomer.

5. A member according to claim 1, wherein said protective layer comprises electroconductive particles.

6. A member according to claim 5, wherein said electroconductive particles comprise a metal oxide.

7. An electrophotographic photosensitive member, comprising: at least a support, and a charge generation layer, a charge transport layer and a protective layer disposed in this order on the support, wherein said charge transport layer comprises a polysilane, and said protective layer comprises a cured product obtained from a condensation product between a silyl acrylate compound and colloidal silica.

8. A member according to claim 7, wherein said silyl acrylate compound has at least one alkoxysilyl group and at least one double bond.

9. A member according to claim 7, wherein said silyl acrylate compound is represented by the formula (1) shown below and said polysilane is represented by the formula (2) shown below:

(1)

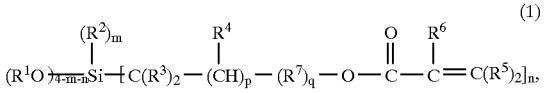

wherein $R^1$ denotes an alkyl group; $R^2$ denotes an alkyl group, an alkoxy group or an aryl group; $R^3$, $R^4$, $R^5$ and $R^6$ independently denote hydrogen atom, an alkyl group, an alkoxy group or an aryl group; $R^7$ denotes an alkylene group; m is an integer of 0–2 and n is an integer of 1–3 satisfying $0<m+n\leqq 3$; and p and q independently denotes an integer of at least 0; and (2)

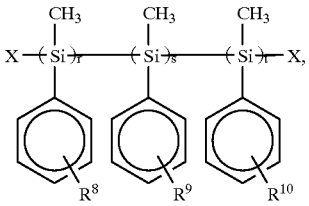

wherein $R^8$, $R^9$ and $R^{10}$ independently denote an alkyl group or an aryl group each optionally having a substituent; each X independently denotes an alkyl group optionally having a substituent, an alkoxy group optionally having a substituent, an aryl group optionally having a substituent, or a halogen atom; and r, s and t independently denote an integer of at least 0 satisfying r+s+t>10.

10. A member according to claim 7, wherein said cured product is obtained from said condensation product and a polyfunctional acrylic monomer.

11. A member according to claim 7, wherein said protective layer comprises electroconductive particles.

12. A member according to claim 11, wherein said electroconductive particles comprise a metal oxide.

13. An electrophotographic apparatus, comprising: an electrophotographic photosensitive member according to claim 1 or 7, charging means for charging said photosensitive member, imagewise exposure means for exposing imagewise the charged photosensitive member to form an electrostatic latent image on said photosensitive member, and developing means for developing the latent image with a toner.

14. A process cartridge, comprising: an electrophotographic photosensitive member according to claim 1 or 7 and charging means for charging said photosensitive member.

15. A process cartridge according to claim 14, which comprises developing means for developing an electrostatic image formed on said photosensitive member.

* * * * *

UNITED STATES PATENT AND TRADEMARK OFFICE

CERTIFICATE OF CORRECTION

PATENT NO. : 5,912,098

DATED : June 15, 1999

INVENTOR(S) : TAKAKAZU TANAKA ET AL.

It is certified that error appears in the above-identified patent and that said Letters Patent is hereby corrected as shown below:

COLUMN 2

Line 20, "groups," should read --group,--;
Line 21, "group," should read --groups,--.

COLUMN 3

Line 1, "DRAWINGS" should read --PREFERRED EMBODIMENT--;
Line 16, "an" should read --a--.

COLUMN 5

Ex. Comp. No. (17), "$-CH_2-CH_2-$" should read $---(CH_2)_3---$.

COLUMN 6

Ex. Comp. No. (26), "$CH_2-$" should be deleted;
Line 53, "used" should read –be used--.

COLUMN 10

Monomer No. (21), " 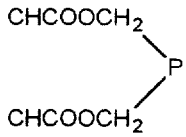 " should read -- 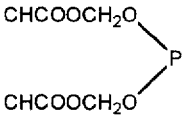 --;

Monomer No. (27), " 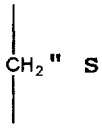 " should read -- 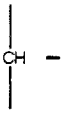 --.

UNITED STATES PATENT AND TRADEMARK OFFICE

CERTIFICATE OF CORRECTION

PATENT NO. : 5,912,098

DATED : June 15, 1999

INVENTOR(S) : TAKAKAZU TANAKA ET AL.

It is certified that error appears in the above-identified patent and that said Letters Patent is hereby corrected as shown below:

COLUMN 12

Line 59, "an" should read —and—.

COLUMN 17

Line 2, "be" should be deleted;
Line 28, "invention," should read —invention—.

COLUMN 18

Line 62, "s" should read —as—.

COLUMN 22

Line 54, "a" should read —an—.

COLUMN 24

Table 5, "(-V)" should read —(V)-- (both occurrences).

UNITED STATES PATENT AND TRADEMARK OFFICE

CERTIFICATE OF CORRECTION

PATENT NO. : 5,912,098

DATED : June 15, 1999

INVENTOR(S) : TAKAKAZU TANAKA ET AL.

It is certified that error appears in the above-identified patent and that said Letters Patent is hereby corrected as shown below:

COLUMN 26

Line 48, "

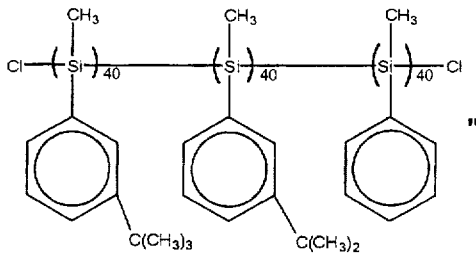

" should read

--

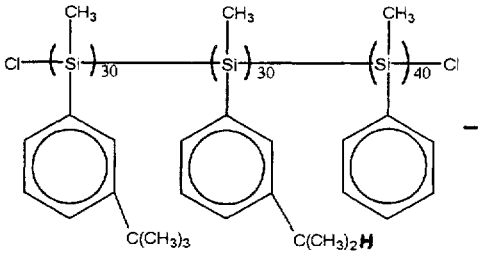

--.

COLUMN 28

Line 37, "R" should read --R'--;
Line 42, "denotes" should read --denote--.

UNITED STATES PATENT AND TRADEMARK OFFICE

CERTIFICATE OF CORRECTION

PATENT NO. : 5,912,098

DATED : June 15, 1999

INVENTOR(S) : TAKAKAZU TANAKA ET AL.

It is certified that error appears in the above-identified patent and that said Letters Patent is hereby corrected as shown below:

COLUMN 29

Line 12, "denotes" should read --denote--.

Signed and Sealed this

First Day of August, 2000

*Attest:*

Q. TODD DICKINSON

*Attesting Officer*

*Director of Patents and Trademarks*